US007806069B2

(12) United States Patent
Bryant et al.

(10) Patent No.: US 7,806,069 B2
(45) Date of Patent: Oct. 5, 2010

(54) SYSTEM FOR ATTACHING A FLEXIBLE COVER AND AN EDGE CLIP FOR THE SAME

(75) Inventors: Michael James Bryant, Bradenton, FL (US); Brent Lee Bucks, Lakewood Ranch, FL (US); Stuart Allan Tyson, Bradenton, FL (US); Dennis J. Parniske, Parrish, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 179 days.

(21) Appl. No.: 12/189,585

(22) Filed: Aug. 11, 2008

(65) Prior Publication Data

US 2010/0031865 A1 Feb. 11, 2010

(51) Int. Cl.
*B63B 17/00* (2006.01)
*B63B 17/02* (2006.01)

(52) U.S. Cl. ..... 114/361

(58) Field of Classification Search ..... 114/361
See application file for complete search history.

(56) References Cited

U.S. PATENT DOCUMENTS 3,172,419 A * 3/1965 Lewis ..... 135/119
3,192,542 A * 7/1965 Mills, II ..... 114/361
3,572,353 A * 3/1971 Pinkley ..... 114/361
3,707,022 A 12/1972 Diehl
4,049,301 A 9/1977 Schenk
4,726,625 A 2/1988 Bougher
4,903,349 A 2/1990 Arai
5,331,993 A 7/1994 Billbury
5,367,977 A 11/1994 Ellis et al.
5,396,861 A 3/1995 Acker et al.
5,425,327 A * 6/1995 Zirkelbach et al. ..... 114/361
5,431,365 A 7/1995 Hopkins
5,622,136 A * 4/1997 Zirkelbach et al. ..... 114/361
5,706,753 A 1/1998 Menne et al.
5,816,185 A 10/1998 Ruthrford
5,947,546 A 9/1999 Hilliard et al.
5,970,904 A 10/1999 Wellen et al.
6,026,761 A 2/2000 Parniske et al.
6,588,361 B2 * 7/2003 Biedenweg ..... 114/361
6,886,489 B2 5/2005 Zarn et al.
6,978,519 B2 12/2005 Pontaoe

FOREIGN PATENT DOCUMENTS

JP 2007009589 1/2007

* cited by examiner

*Primary Examiner*—Daniel V Venne
(74) *Attorney, Agent, or Firm*—Nixon & Vanderhye P.C.

(57) ABSTRACT

A system for securing a flexible cover to a boat is described. The system includes a flexible cover defining a peripheral edge and a flexible member attached to the flexible cover adjacent to the peripheral edge. An edge clip is adjustably disposed on the flexible member. The edge clip includes a body defining an inlet and an outlet. The flexible member extends from the inlet to the outlet. A retaining element is disposed within the body to discourage movement of the flexible member with respect to the inlet and the outlet. The system also includes a hook, connectible between the edge clip and the boat for securing the edge clip to the boat, thereby securing the flexible cover to the boat via the flexible member.

24 Claims, 11 Drawing Sheets

SYSTEM FOR ATTACHING A FLEXIBLE COVER AND AN EDGE CLIP FOR THE SAME

CROSS-REFERENCE TO RELATED APPLICATION(S)

This United States Patent Application is a first-filed patent application and does not rely on any other patent application for priority.

FIELD OF THE INVENTION

The invention described herein relates to clips and related fasteners and systems that are used to secure one structure in relation to another. More specifically, the invention concerns an edge clip that facilitates securement of a flexible cover to a vehicle. Even more specifically, the invention encompasses an edge clip that secures a flexible top to a boat windshield.

DISCUSSION OF RELATED ART

Many boats, particularly those suited for recreational use, are designed with an open passenger area. The passenger area typically is behind a windshield, in front of a helm, where a pilot or user sits. For some designs, the open passenger area may include an overarching structure, such as a canopy (retractable or non-retractable), an electronics arch, or an upper deck. For other designs, the passenger area may not have any structure extending above it.

Regardless of the exact layout of the deck of the boat, there has always been a desire and a need by boat owners to enclose the passenger area for different reasons.

As should be appreciated by boat users, there is a need (or at least a desire) to cover the passenger area of a boat at least when the boat is docked and not being used. Accordingly, many (if not most) boat owners possess a flexible cover that extends across the passenger area. The flexible top typically connects to fasteners at the periphery of the passenger area.

For boats where the passenger area is underneath an overarching structure, boat owners and/or users often elect to purchase a flexible cover that extends between the windshield of the boat and the overarching structure. Not only is this flexible cover used to secure the boat when docked, but it often may be employed to provide a windscreen when the boat is in motion or a sunscreen, as should be appreciated by those skilled in the art.

It is known to incorporate into a flexible cover one or more transparent panes. The transparent panes are useful when the flexible cover is installed during operation of the boat. The transparent panes, for example, provide the pilot with increased forward visibility if the flexible cover is installed while the boat is being operated.

Regardless of the type of flexible cover a boat owner may choose, there has developed an increasing desire for simple, attractive ways to secure a flexible cover to a boat.

In a common prior art example, the flexible cover includes a plurality of female portions of snap fasteners attached at regular intervals at the periphery of the cover. To secure the flexible cover to the boat, the boat itself usually includes an equal number of male portions of the fasteners attached to the boat deck and to the windshield top edge.

As should be appreciated by boat owners, affixing the flexible cover to the boat deck involves aligning the fasteners in the correct orientation and press-fitting the fasteners together.

As should be apparent to boat owners, aligning the flexible top to the boat deck so that the male and female portions of the fasteners are in register with one another is often a tedious task.

Moreover, connection of the male and female portions of the fasteners to one another requires that the boat owner position himself or herself exterior to the passenger area. This contributes to the awkwardness of attaching the flexible cover to the deck.

These difficulties are exacerbated when the boat is not docked but is on open water. In particular, if unfavorable weather conditions develop, the boat owner may wish to deploy the flexible cover between the windshield and an overarching structure so that the boat owner may minimize the effect of the adverse weather on himself or herself and any passengers.

As may be appreciated by those skilled in the art, one reason that the prior art fastener system is made more awkward when a boat is not docked is that the boat may have a greater tendency to rock on open water. This may lengthen the process for aligning the fastener portions to one another.

As also may be appreciated by those skilled in the art, since the male portions of the fasteners are exterior to the passenger area, the boat owner is required to be outside of the passenger area when affixing the flexible cover. This may prove particularly unpleasant during adverse weather.

As should be appreciated by boat manufacturers, there can be appreciable differences in the final, constructed versions of boats, even when they are of the same model type. Accordingly, placement of snap fasteners in the same location on the boat may result in an ill-fitted flexible cover. In other words, it is possible that a flexible cover may fit well on one boat but present challenges on a subsequent boat of the same model.

In addition, temperature presents a challenge with respect to the flexible cover. A flexible cover properly affixed to a boat in cold weather may expand in hot weather, thereby reducing the tightness of the fit of the flexible cover to the boat. Along these lines, a boat owner may find that a flexible cover, while properly fitted at one temperature, does not fit properly at another.

In a related instance, flexible covers age when exposed to the environment, and this aging process may transform a fitted cover to one that presents challenges when the user tries to install the flexible cover.

Boat cover manufacturers also recognize that many boat enthusiasts do not like the appearance of the male portions of the fasteners attached to their boats. They believe that the "studded" appearance is not sleek and would prefer an alternative system for affixing a flexible cover to the deck of a boat.

As a result of at least these factors, among others, there has developed a desire for systems for attaching flexible covers to boats without the use of fasteners.

There also has developed a desire for flexibility and adaptability of flexible covers to improve their installation in different temperatures and over time.

In addition, there has developed a desire for an attachment system that permits a use to attach a flexible cover to the deck of a boat while the user remains in the passenger area of the boat.

SUMMARY OF THE INVENTION

It is, therefore, an aspect of the invention to resolve one or more of the deficiencies noted with respect to the prior art.

For example, the invention is intended to provide a system for attachment of a flexible cover to a structure, such as a boat windshield, without the need for snap fasteners.

In addition, the invention is intended to provide designs for an edge clip intended to facilitate attachment of a flexible cover to a structure, such as the top rail of a windshield on a boat.

Next, the invention is intended to provide flexibility in attaching a flexible cover to a structure. For example, the invention accommodates changes in the size of the flexible cover due to temperature or age variations. In addition, the invention accommodated differences from one boat to the next, even when the two boats are the same model.

Furthermore, the invention is intended to facilitate attachment of a flexible cover to a boat from the interior of the boat.

The invention also is intended to provide a system that does not require the user to connect the flexible cover to the exact same location on the boat each time the cover is installed. In other words, the user is not required, as in the prior art, to make sure that each of the snap fasteners are in register when attaching the cover to the boat.

The invention provides a system that permits the edge of the cover to present a greater departure angle from the boat surface (i.e., the windshield assembly) than is possible with a snap fastener system. It is contemplated that the edge may depart from the structure by an angle between 0 and 180° or more.

Since the invention includes flexible members, such as straps, that extend between an edge of the flexible cover and the structure to which the cover is attached, the flexible members permit adjustment of the fit of the flexible cover on the structure, such as a boat.

While not intended to be limiting of the invention, one contemplated embodiment encompasses a system for securing a flexible cover to a boat. The system may include a flexible cover defining a peripheral edge. At least one flexible member may be attached to the flexible cover adjacent to the peripheral edge. At least one edge clip may be adjustably disposed on the flexible member. The at least one edge clip may comprise a body defining an inlet and an outlet, with the at least one flexible member extending from the inlet to the outlet. A retaining element may be disposed within the body to discourage movement of the flexible member with respect to the inlet and the outlet. The system also may include a hook, connectible between the at least one edge clip and the boat for securing the edge clip to the boat, thereby securing the flexible cover to the boat via the at least one flexible member.

In contemplated embodiments of the invention, the flexible cover may be made from a woven material, a non-woven material, and/or a transparent material, among other materials.

The at least one flexible member may comprise a lanyard, a rope, a string, and a strap, among other contemplated variations.

A portion of the peripheral edge may include a sealing element.

A portion of the peripheral edge may also include a stiffening element. If a stiffening element is provided, the stiffening may define a first axis and a structure on the boat may define a second axis. An angle between the first and second axes may be adjustable between 0 and 180° or more.

With respect to one contemplated embodiment of the retaining element, it is contemplated that the retaining element may include a lever pivotally disposed in the body. The lever may define an opened position and a closed position such that, in the opened position, the lever permits the at least one flexible member to move between the inlet and the outlet and, in the closed position, the lever discourages the at least one flexible member from moving between the inlet and the outlet. One or more teeth may be provided to engage the at least one flexible member when the lever is in the closed position. A spring may be added to bias the lever into engagement of the at least one flexible member.

It is also contemplated that the system may incorporate a fastener disposed on first and second ends of the at least one flexible member to permit the first and second ends of the at least one flexible member to be connected to one another when the lever is in the closed position.

Alternatively, it is contemplated that the retaining element may include a barrier disposed within the body, wherein the at least one flexible member extends around the barrier in such a manner that tension on the at least one flexible member discourages movement of the at least one flexible member between the inlet and the outlet. A fastener may be disposed on first and second ends of the at least one flexible member to permit the first and second ends of the at least one flexible member to be connected to one another, thereby providing the tension to discourage movement of the at least one flexible between the inlet and the outlet.

In this contemplated embodiment, a tongue may be positioned within the body adjacent to the barrier to help direct the at least one flexible member from the inlet to the outlet.

It is contemplated to provide a hook integrally formed with the edge clip to secure the edge clip to a structure on the boat. The hook may take any number of shapes, including U-shaped, S-shaped, and others. The hook may be removably connectable to the body of the edge clip.

The edge clip may be secured on an interior surface of the boat, within a passenger area, while the portion of the peripheral edge of the flexible cover engages an exterior surface of the boat, outside of the passenger area.

The invention also contemplates a system for securing a flexible cover to a boat that includes a flexible cover defining a peripheral edge. At least one flexible member may be attached to the flexible cover adjacent to the peripheral edge. At least one edge clip may be adjustably disposed on the flexible member, wherein the at least one edge clip comprises a body defining an inlet and an outlet, with the at least one flexible member extending from the inlet to the outlet, and a barrier disposed within the body, wherein the at least one flexible member extends around the barrier to establish a reversal in a direction of the at least one flexible member between the inlet and the outlet. A fastener may be disposed on first and second ends of the at least one flexible member to permit the first and second ends of the at least one flexible member to be connected to one another to provide tension in the at least one flexible member, wherein at least the barrier and the fastener cooperate to discourage the at least one flexible member from moving with respect to the inlet and the outlet. A hook, connectible between the at least one edge clip and the boat for securing the edge clip to the boat, may secure the flexible cover to the boat via the at least one flexible member.

Other aspects of the invention will be made apparent from the discussion that follows.

BRIEF DESCRIPTION OF THE DRAWINGS

The invention will now be described in connection with several figures of drawings, in which.

DESCRIPTION OF PREFERRED EMBODIMENT(S) OF THE INVENTION

While the invention is described in connection with several embodiments, as enumerated below and as illustrated herein, the invention is not intended to be limited solely to the embodiments provided. To the contrary, the embodiments emphasized are intended merely to be illustrative of selected examples that fall within the broad scope of the subject matter of the invention.

Figure 1:
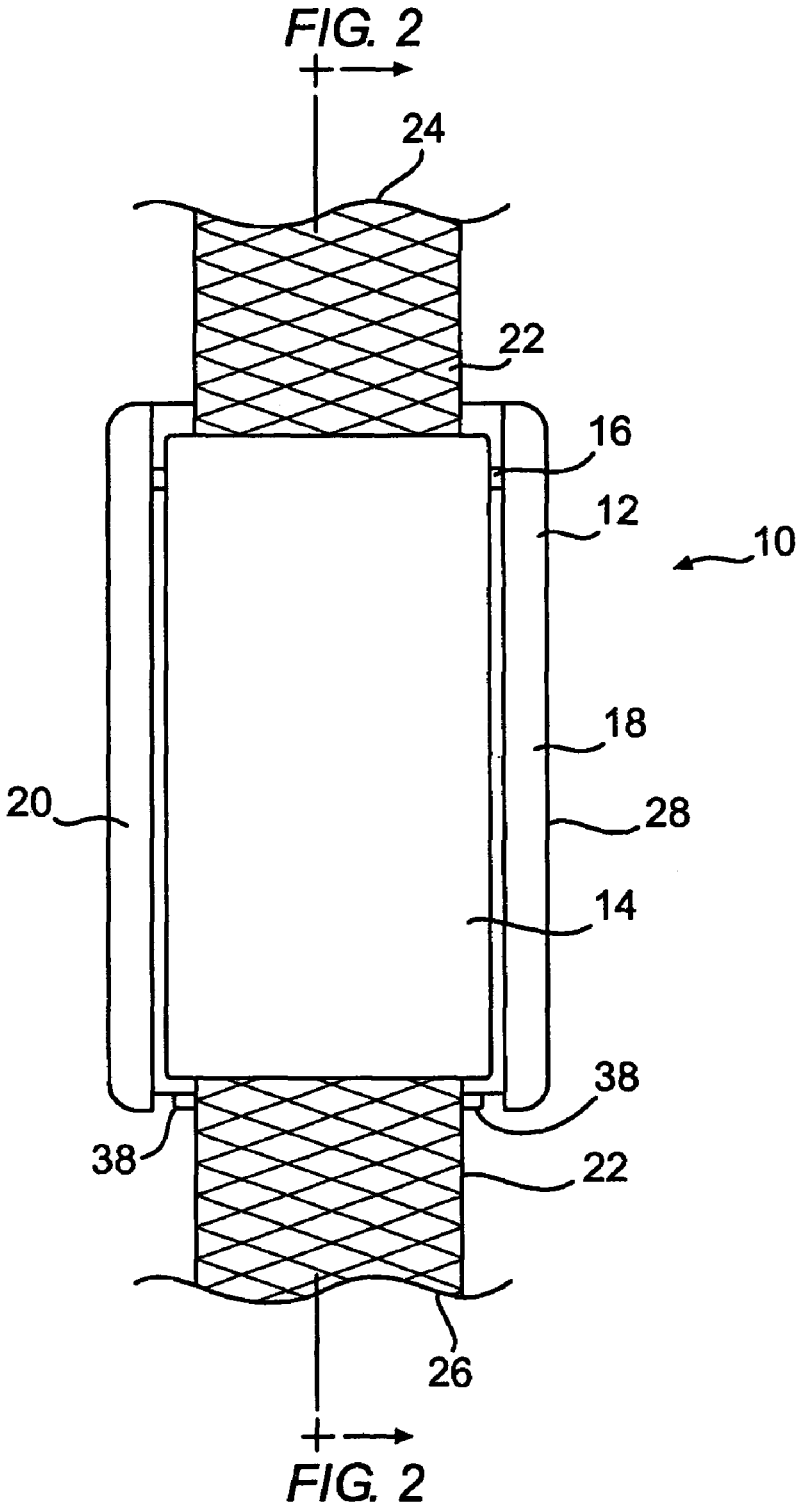
FIG. 1 is a top view of a first embodiment of an edge clip of the invention.

FIG. 1 illustrates one embodiment of an edge clip 10 according to the invention. The edge clip 10 includes a bracket portion 12 and a lever portion 14. The lever portion 14 is pivotally mounted on a rod 16 that extends between a first side edge 18 and a second side edge 20 of the edge clip 10. A strap 22 extends through the edge clip 10. The strap 22 has a top end (or a first end) 24 and a bottom end (or a second end) 26. The top end 24 extends to a flexible cover for a boat, which is discussed in greater detail below. The bottom end 26 of the strap 22 includes attachment means (described in greater detail below) to keep the bottom end 26 of the strap 22 in a properly-stowed position.

With further reference to the strap 22, it is contemplated that the strap 22 will be made from a suitable woven material. Of course, the strap 22 also may be constructed from a non-woven material. As should be apparent, the strap 22 may be made from any suitable material including synthetic and non-synthetic substances. In addition, it is contemplated that the strap 22 may be replaced by a suitable lanyard, rope, string or other means capable of assisting with the securement of a flexible cover, which is discussed in greater detail below. In other words, while the invention is described in connection with a strap 22, reliance on a strap 22 is not required to practice the invention.

The edge clip 10 includes a body 28. The body 28 includes the first side edge 18 and the second side edge 20 connected by a base portion 30. In the illustrated embodiment, the base 30, the left side edge 18, and the right side edge 20 are connected to one another to form a U-shaped structure. The rod 16 extends between the first side edge 18 and the second side edge 20 and pivotally supports the lever portion 14.

In the illustrated embodiment, the rod 16 and the lever 14 are separate elements. As should be appreciated by those skilled in the art, the rod 16 may be incorporated integrally into the lever portion 14. In this example, the rod 16 may be made as a metal rod around which the lever is molded, for example. In a separate embodiment, the rod 16 may be formed together with the lever 14 from the same material. In this second example, it is contemplated that the lever 14 may be molded from a plastic or resinous material and the rod 16 may comprise rod-like protrusions that extend laterally from both sides of the lever 14. Of course, plastics and resinous materials are not the only materials contemplated to construct the lever portion 14 and the rod 16. Other materials include, but are not limited to metals including aluminum and associated alloys, steels, stainless steels, metal alloys, ceramics, composite materials, and more.

While not required to practice the invention, the material selected for the lever 14, the rod 16, and the body 28 may be a material that resists corrosion in a marine environment. In addition, the material may be selected to be light-weight. Other factors also may be taken into account when selecting the material. For example, since the edge clip 10, when used in an outdoor environment, may be exposed to sunlight, elements that comprise the edge clip 10 may be selected from those that are resistant to exposure to sunlight, including ultra violet light. For example, the materials selected may resist color fading and cracking.

In the illustrated embodiment, the body 28 is contemplated to be made from the same material as the lever portion 14. Of course, the body 28 and the lever 14 may be made from different materials without departing from the scope of the invention. Moreover, the body 28 and the lever 14 may be made from combinations of different materials (e.g., composites, etc.) without departing from the scope of the invention.

Figure 2:
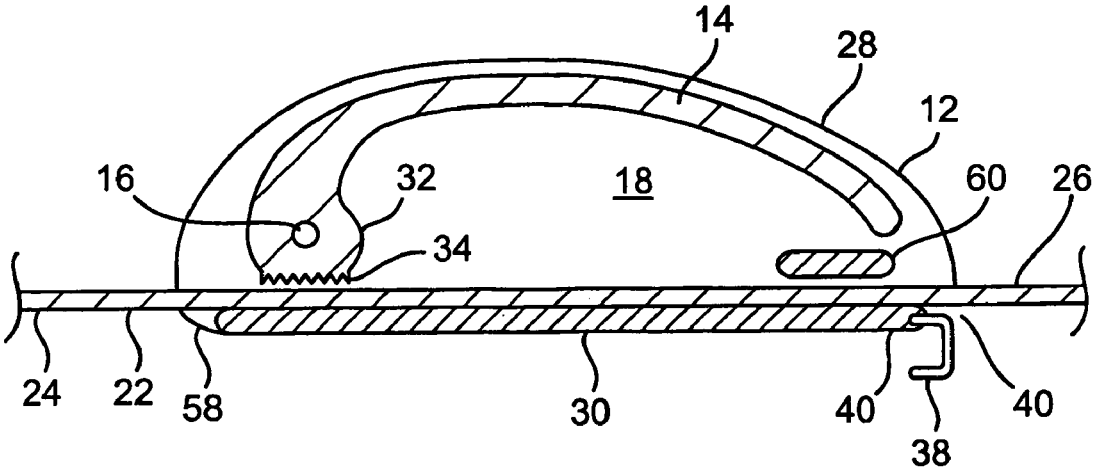
FIG. 2 is a cross-sectional side view of the edge clip illustrated in FIG. 1.

As illustrated in FIG. 2, the strap 22 passes through the body 28 such that the strap 22 extends between the securing end 32 of the lever 14 and the base portion 30. The securing end 32 of the lever includes a plurality of gripping teeth 34 that are positioned to hold the strap 22 in position within the body 28 once the lever 14 is in the closed position, as illustrated in FIG. 2.

Figure 3:
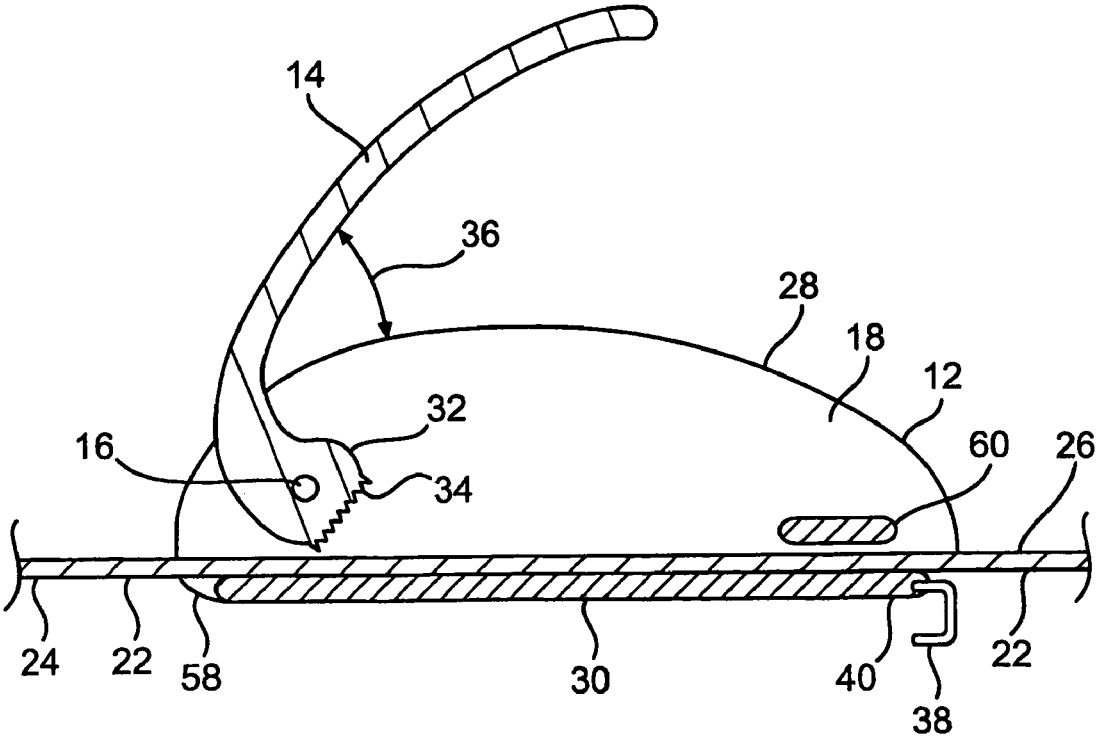
FIG. 3 is a cross-sectional side view of the edge clip illustrated in FIG. 2, shown with the engagement lever in an elevated (or opened) position.

FIG. 3 illustrates the edge clip 10 with the lever 14 in the opened position. As shown, the lever 14 may move in an arcuate manner about the pivot defined by the rod 16 connecting the lever 14 to the first and second side edges 18, 20. This arcuate motion is indicated by the arrow 36.

A comparison between FIGS. 2 and 3 illustrates how the teeth 34 on the securing end 32 of the lever engage the surface of the strap 22 within the body 28. It is noted that the teeth 34 are contemplated to be positioned to provide an adequate holding force on the strap 22 when the lever 14 is in the closed position. When the lever 14 is in the opened position as illustrated in FIG. 3, the teeth 34 disengage the strap 22 so that the strap may move freely within the body 28.

To encourage a greater affinity between the teeth 34 and the strap 22, it is contemplated that the top end 32 of the lever 14 may include an elliptical or eccentric shape to bias the teeth 34 into engagement with the strap 22 when the lever 14 is in the closed position. As should be immediately apparent, the shape of the top end 32 of the lever 14 need not be elliptical or eccentric. There are numerous other shapes that may be employed to enhance the gripping strength of the lever 14 when in the closed position.

It is contemplated that the top end 32 of the lever 14 and the teeth 34 may be designed to apply an increasingly greater tensioning force on the strap 22 as the user applies tension to the bottom end 26 of the strap 22.

The teeth 34 are contemplated to be molded integrally with the lever 14. Of course, as should be apparent to those skilled in the art, the teeth 34 may not be integrally formed with the lever 14. Instead, the teeth may be separate members that are added to the lever 14 after manufacture. Other variations should be apparent to those skilled in the art. Those variations are also considered to fall within the scope of the invention.

For purposes of the instant disclosure, the lever 14, the teeth 34, and the base portion 30 cooperate, along with other elements, to retain the strap 22 when the lever 14 is in the closed position. As such, these three structures are generally referred to as a retaining element. As should be appreciated by those skilled in the art, and as discussed in greater detail below, variations and equivalents of the retaining element may be employed without departing from the scope of the invention.

As also illustrated in FIGS. 2 and 3, the edge clip 10 includes a hook 38. The hook 38 is embedded in the bottom end 40 of the body 28. Of course, as should be immediately apparent, the hook 38 may be integral with the body 28 without departing from the scope of the invention. In the illustrated embodiment, the hook 38 is made from a suitable material, such as metal, to present a minimal cross-sectional aspect. As will be discussed in greater detail with respect to FIG. 4, the hook 38 is provided for engagement with a bottom edge of a top rail of a boat windshield frame.

Figure 4:
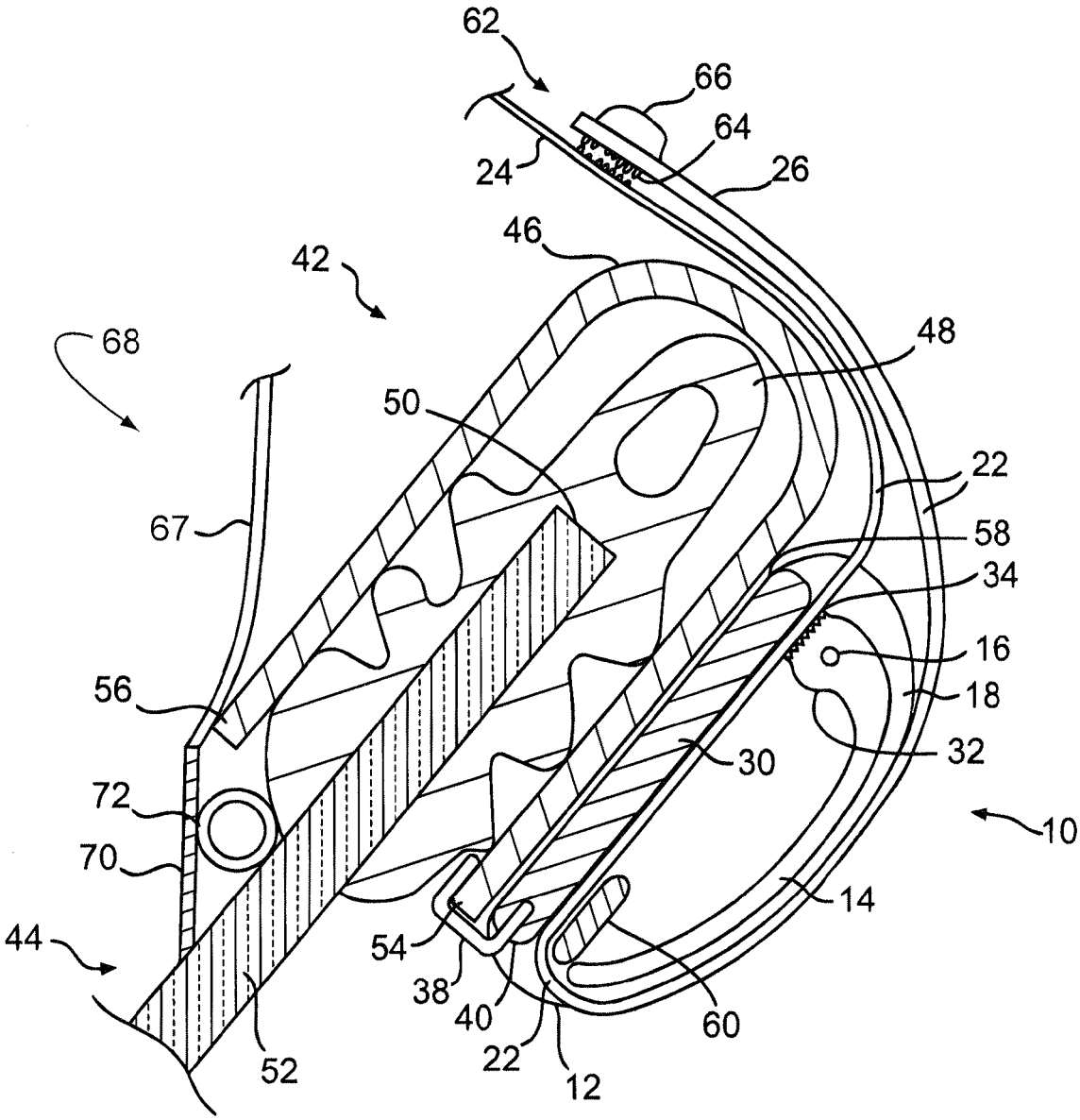
FIG. 4 is a cross-sectional side view of the edge clip illustrated in FIG. 1, shown with the edge clip attached to a top rail of a windshield and with the strap folded over the engagement lever and connected to itself.

Reference is now made to FIG. 4, which illustrates the edge clip 10 positioned adjacent to and connected to a top rail 42 of a boat windshield frame. It is noted that the edge clip 10 need not be used in combination with only a top rail 42 of a windshield frame. As should be apparent, the edge clip 10 may be employed to engage any suitable structure on the deck of a boat without departing from the scope of the invention.

The top rail 42 is a portion of a frame for a windshield assembly 44. In the illustrated example, the top rail 42 includes a U-shaped cap 46 with an interior leg 54 and an exterior leg 56. The U-shaped cap 46 is the portion of the top rail 42 that is visible to the observer. Usually, the U-shaped cap 46 is made from a suitable metal material, such as aluminum or stainless steel. Of course, as should be appreciated by those skilled in the art, the U-shaped cap 46 may be made from any number of different materials without departing from the scope of the invention.

The U-shaped cap 46 covers an insert 48 that is affixed to a top end 50 of a windshield pane 52. The insert 48 is essentially a U-shaped structure made from a resilient material, such as rubber or the like. The insert 48 provides a resilient cushion to protect the top end 50 of the windshield pane 52. The insert 48 also holds the cap 46 at the top end 50 of the windshield pane 52, as illustrated.

The insert 48 may be affixed to the top end 50 of the windshield pane 52 via a suitable adhesive. Alternatively, a press fit between the insert 48 and the windshield pane 52 may be employed without an adhesive. The insert 48, in turn, may be affixed to the interior of the cap 46 via a suitable adhesive. Alternatively, a press fit between the insert 48 and the cap 46 may be employed without any adhesive. As should be appreciated by those skilled in the art, other arrangements are also possible and are intended to fall within the scope of the invention.

As illustrated in FIG. 4, the hook 38 on the edge clip 10 engages the interior leg 54 of the cap 46. Engagement of the interior leg 54 by the hook 38 secures the edge clip 10 to the top rail 42.

In FIG. 4, the hook 38 is shown as being positioned between the insert 48 and the interior leg 54 of the top rail 42. It is also contemplated that the hook may be positioned between the insert 48 and the windshield pane 52. In this alternative arrangement, the hook 38 presses the insert 48 against the interior leg 54, thereby improving the gripping strength of the hook 38 onto the interior leg 54.

As shown in FIG. 4, the strap 22 is threaded through the edge clip 10 from the top end (or inlet) 58 to the bottom end (or outlet) 40 of the body 28. The strap 22 extends beneath a retaining wall 60 within the edge clip 10. The retaining wall 60 helps to keep the strap 22 flush against the base portion 30 of the body 28.

When the lever 14 is in the closed position, the strap 22 is folded over the lever 14, as shown in FIG. 4. The bottom end 26 of the strap 22 is then moved into close proximity to the top end 24 of the strap 22. The top end 24 and the bottom end 26 of the strap 22 are provided with a fastener 62. In this case, the fastener 62 combines hook and loop fastening means 64 and a button 66. The hook and loop fastening means 64 engage one another to hold the bottom end 26 of the strap 22 next to the top end 24 of the strap. In this manner, the bottom end 26 of the strap does not fall into the field of view of the windshield pane 52. As should be appreciated by those skilled in the art, hook and loop fastening means 64 need not be used. Any other suitable fastener may be employed, such as a traditional, press-fit, button fastener, without departing from the scope of the invention.

As illustrated, the top end 24 of the strap 22 connects to a peripheral edge 67 of a flexible top 68. The flexible top 68 extends over the passenger area of the boat, as discussed above. The flexible top 68 may be constructed from a woven material, such as a canvas or the like. Alternatively, the flexible top 68 may be made from a non-woven material, such as neoprene or the like. As also may be appreciated by those skilled in the art, the flexible cover 68 may incorporate both woven and non-woven materials. In addition, the flexible cover 68 may incorporate one or more transparent panels that operate as transparent windscreens. The transparent panels may be any of a number of flexible, semi-flexible, or rigid materials, including Lexan®, acrylic materials, and polycarbonate materials, which are known to those skilled in the art.

With respect to the use of woven or non-woven materials, there are a wide variety of such materials that are known to those skilled in the art. These materials may be inherently waterproof or may be treated to be waterproof. In addition, since the flexible cover 68 is expected to be exposed to sunlight, the materials may be light resistant. In other words, the materials may resist fading and cracking when exposed to sunlight for extended periods of time.

While not required to practice the invention, a bottom portion 70 of the flexible top 68 may include a stiffening element so that the bottom portion 70 presents a more rigid edge when pressed against the cap 46 and the windshield pane 52. The bottom portion 70 of the flexible top 68 also may be provided with a seal 72, such as a compressible or incompressible gasket, to provide additional sealing capability between the flexible top 68 and the cap 46 or windshield pane 52. The combination of the stiffened bottom portion 70 and the seal 72 is contemplated to provide an effective seal between the flexible top 68 and the windshield assembly 44. Moreover, the stiffened bottom edge 70 provides a smooth exterior appearance for the flexible top 68 at the juncture with the windshield assembly 44, which is particularly attractive to boating enthusiasts. The stiffened bottom portion 70 and the seal 72 also may be employed for the portions of the flexible cover 68 that engage the deck of the boat to assure an attractive seal between the flexible top 68 and the deck.

Figure 5:
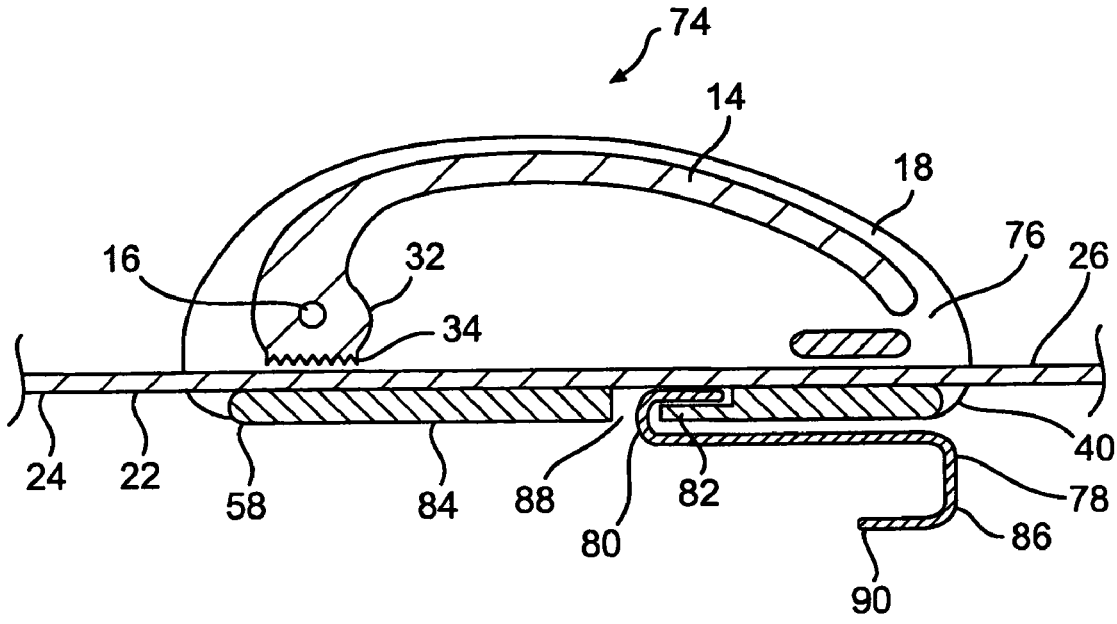
FIG. 5 is a cross-sectional side view of a second embodiment of the edge clip of the invention.

FIG. 5 illustrates a second embodiment of the edge clip 74 of the invention. In this embodiment, the body 76 of the edge clip 74 is much the same as that of the edge clip 10. However, in this embodiment, an S-shaped hook 78 connects the edge clip 74 to the cap 46 of the windshield assembly 44. A top end (or first end) 80 of the S-shaped hook 78 engages a complimentary hook retainer 82 in the base portion 84 of the body 76. The bottom end (or second end) 86 of the S-shaped hook 78 engages an interior leg 54 of the cap 46. So that the top end 80 of the S-shaped hook 78 may engage the hook retainer 82, the base portion 84 of the edge clip 76 is provided with a slot 88. The slot 88 permits the top end 80 of the S-shaped hook 78 to engage the hook retainer 82.

The edge clip 74 in this second embodiment is intended to be removable from the S-shaped hook 78. In other words, unlike removal of the edge clip 10 from the cap 46 as in the first embodiment, where the hook 38 is removed with the edge clip 10, it is anticipated that the S-shaped hook 78 will remain affixed to the interior leg 54 of the cap 46 when the edge clip 74 is disengaged therefrom.

This second embodiment, therefore, is intended to present an alternative embodiment where the S-shaped hook 78 remains affixed to the windshield assembly 44 in cases where the user prefers this particular arrangement. In this second embodiment, it is contemplated that the hook leg 90 will be inserted between the insert 48 and the interior surface of the cap 46 and that the resilient nature of the insert 58 will help to retain the hook 78 when the edge clip 74 is disengaged therefrom. In a contemplated variation of this embodiment, the hook leg 90 may be inserted between the insert 48 and the windshield pane 52. In this embodiment, the hook leg 90 compresses the insert 48 against the interior leg 54 of the cap 46 to increase the gripping potential of the S-shaped hook 78.

It is contemplated that the S-shaped hook 78 will be movably disposed on the interior leg 54 of the cap 46. Of course, the S-shaped hook 78 could be affixed to the exterior leg 56 without departing from the scope of the invention.

Since the hook leg 90 engages the interior leg 54 of the cap 46, the S-shaped hook 78 is contemplated to be moveable along the length of the interior leg 54 of the cap. As such, the S-shaped hook 78 is infinitely positionable along the length of the interior leg 54 of the cap 46. Not only does this facilitate initial installation of the S-shaped hook 78, but this also permits adjustment of the position of the S-shaped hook 78, as may be needed. Finally, the S-shaped hook 78 may be removed from the cap 46, as desired by the user.

Figure 6:
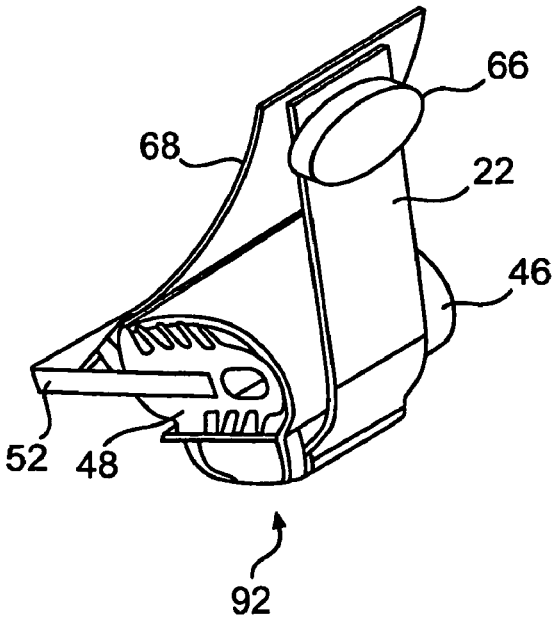
FIG. 6 is a perspective illustration of an edge clip according to the invention that is generic to the third and fourth embodiments of the invention.
Figure 7:
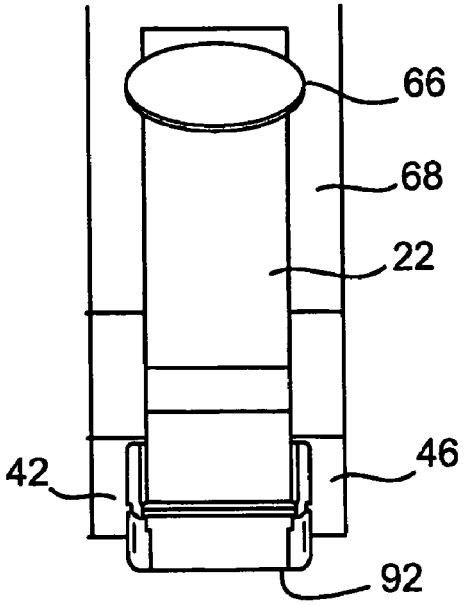
FIG. 7 is a front view of the generic edge clip illustrated in FIG. 6.

FIG. 6 is a side view illustration of a generic edge clip that is representative of the third and fourth embodiments of the edge clip 92 contemplated to fall within the scope of the invention. FIG. 7 is a front view of the same edge clip 92. These drawings help to put into perspective the juxtaposition between the edge clip 92, the top rail 42, and the flexible cover 68, among other elements.

Figure 8:
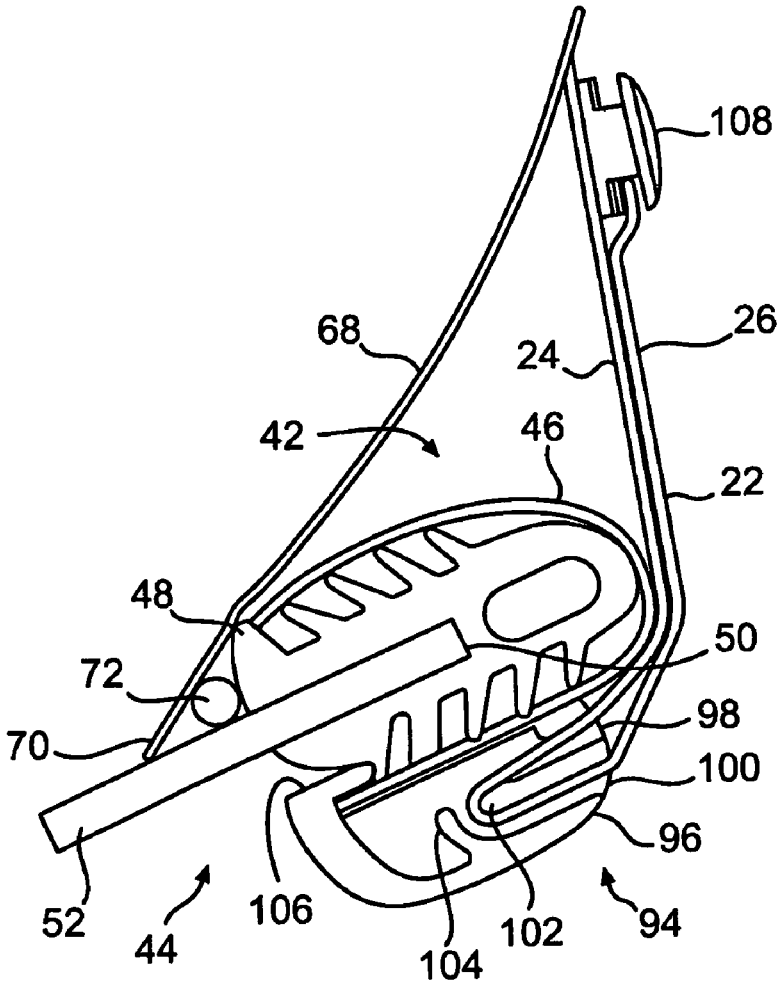
FIG. 8 is a cross-sectional side view of a third embodiment of the edge clip of the invention.

FIG. 8 is a partial cross-sectional side view of a third embodiment of an edge clip 94. In this embodiment, the edge clip 94 is defined by a body 96 with an inlet 98 and an outlet 100. The body also defines a barrier 102 between the inlet 98 and the outlet 100. The body 96 also defines a tongue 104 adjacent to the barrier 102. One end of the body incorporates a hook 106 to engage the cap 46 of the windshield assembly 46.

As illustrated, in this third embodiment, the strap 22 enters the body 96 through the inlet 98, is threaded around the barrier 102, and exits the body through the outlet 100. The tongue 104 provides a structure to assure that the strap 22 is properly threaded within the body 96. In this embodiment, the barrier 102 defines a structure that permits the strap 22 to be reversed in its direction.

The barrier 102 establishes a reversal of the orientation of the strap 22, as shown, which presents a sufficiently large change in the orientation of the strap 22 to discourage slippage of the strap 22 between the inlet 98 and the outlet 100. However, when the strap 22 is not under tension, the strap 22 freely slides between the inlet 98 and the outlet 100, as should be appreciated by those skilled in the art. While the tongue 104 is intended to facilitate threading of the strap 22 within the edge clip 94, the tongue 104 also may be positioned to assist with retention of the strap 22 within the edge clip 94.

In this embodiment, the top end (or first end) 24 and the bottom end (or second end) 26 of the strap 22 are connected to one another via a fastener 108. In the illustrated embodiment, the fastener 108 connects the top end 24 to the bottom end 26 via hook and loop fastening means. However, as discussed above, other fasteners may be employed without departing from the scope of the invention. For example, the fastener 108 may present more traditional male and female portions that snap together. Further still, the fastener 108 may be magnetic.

In this embodiment, it is contemplated that the fastener 108 cooperates with the barrier 102 to establish and maintain a tension on the strap 22 sufficient to secure the flexible cover 68. As should be immediately apparent, the fastener 108 may be replaced with another type of fastener that nay more effectively grip the top end 24 of the strap 22.

Figure 9:
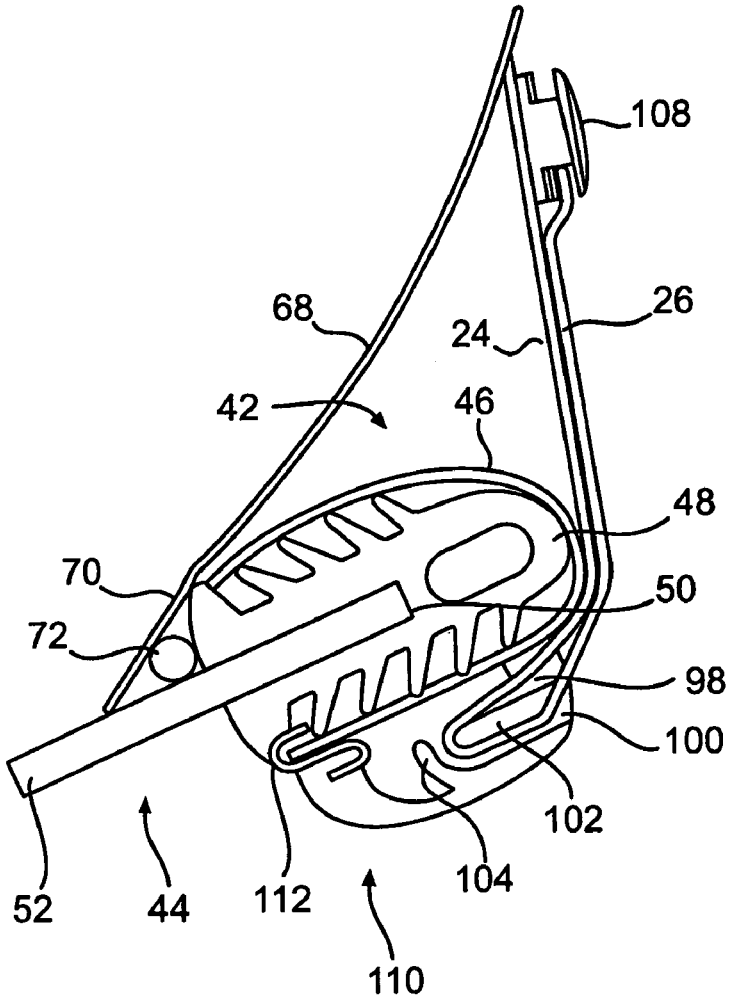
FIG. 9 is a cross-sectional side view of a fourth embodiment of the edge clip of the invention.

FIG. 9 provides a cross-sectional illustration of a fourth embodiment of an edge clip 110. This embodiment is similar to the third embodiment except that the hook 106 has been replaced by an S-shaped hook 112. The S-shaped hook 112 operates in much the same fashion as the S-shaped hook 78. As a result, additional detail concerning this construction is not provided.

Figure 10:
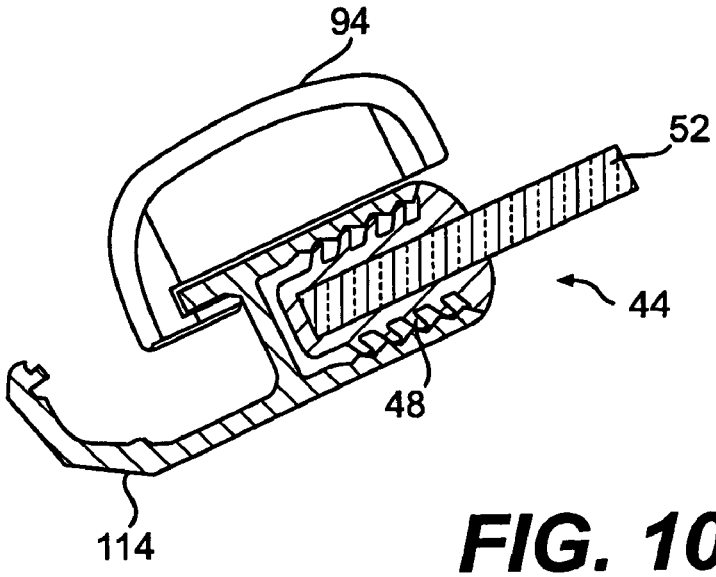
FIG. 10 is a cross-sectional side view of the third embodiment of the edge clip illustrated in FIG. 8, shown attached to a bottom rail of a windshield rather than a top rail.

FIG. 10 illustrates the third embodiment of the edge clip 94. In this illustration, however, the edge clip 94 is affixed to a bottom rail 114 of a windshield assembly 44 rather than a top rail 42. The windshield pane 52 is positioned within an insert 48, just as in the case of the cap 46 of the top rail 42. As should be immediately apparent, any one of the other embodiments of the edge clips could be substituted for the edge clip 94 for attachment to the bottom rail 114.

Figure 12:
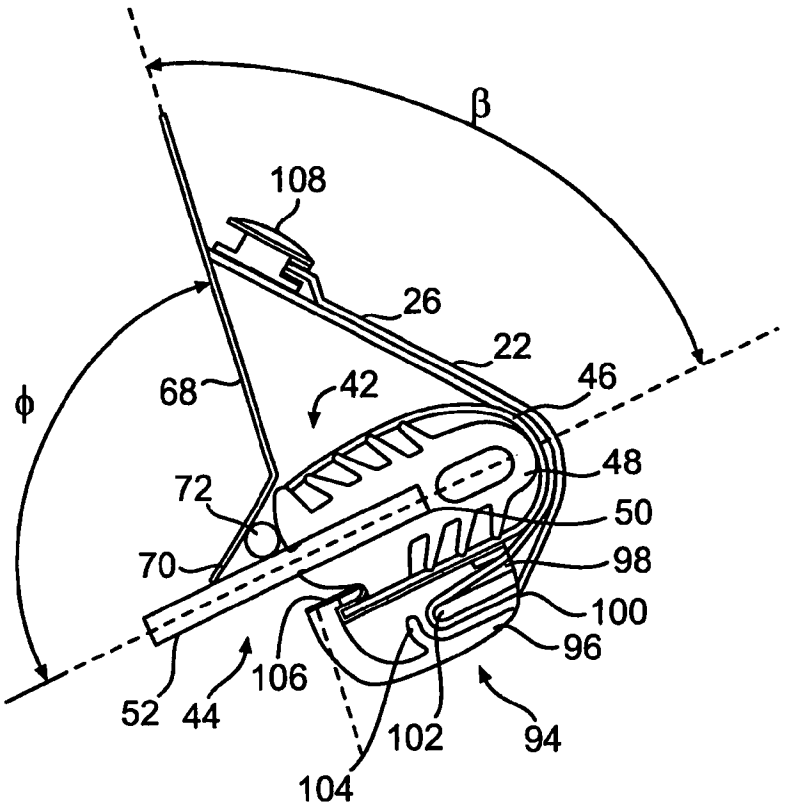
FIG. 12 is a partial, cross-sectional side-view of the edge clip shown in FIG. 8, illustrating a second angular displacement of the flexible cover in connection therewith.
Figure 11:
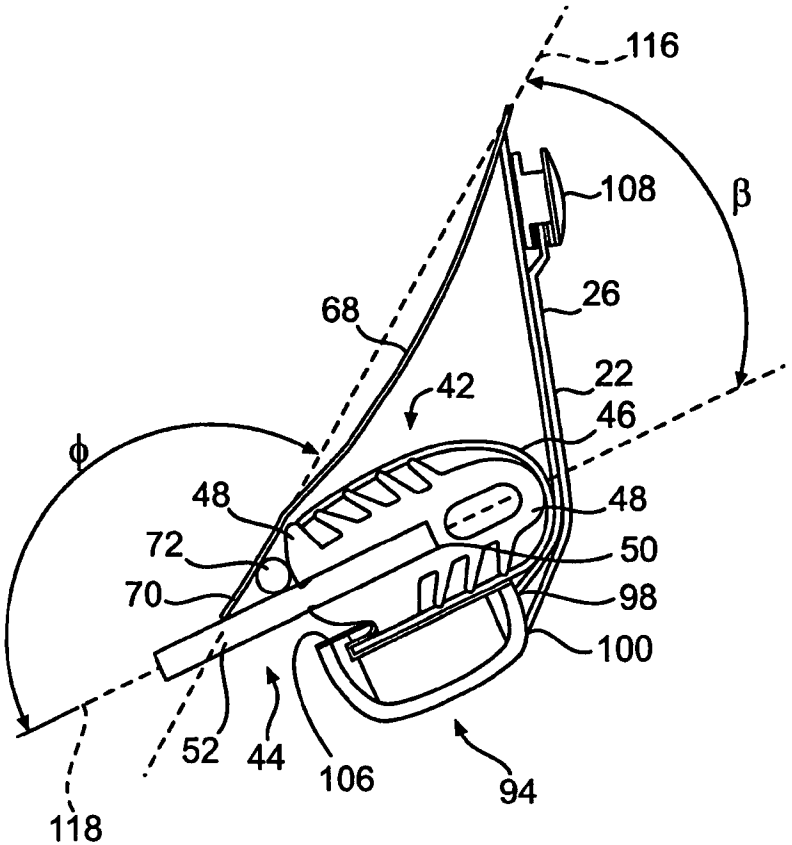
FIG. 11 is a partial, cross-sectional side-view of the edge clip shown in FIG. 8, illustrating a first angular displacement of the flexible cover in connection therewith.

FIGS. 11 and 12 illustrate a further aspect of the invention. Here, the edge clip 94 is shown attached to the top rail 42 of a windshield assembly 44. FIG. 11 illustrate an angle $\Phi$ that is created between a first axis defined by the flexible cover 68 and a second axis 118 defined by the centerline of the windshield pane 52. In FIG. 11, the angle $\Phi$ indicates that the flexible cover 68 may have a relatively small departure angle from the windshield pane 52. In contrast, FIG. 12 illustrates that the flexible cover 68 may have a substantially greater departure angle $\Phi$ from the second axis 118. For reference, a complimentary angle $\beta$ is included in the figures. The angle $\beta$ is complimentary to angle $\Phi$, as is apparent from the illustrations.

As FIGS. 11 and 12 make illustrate, use of an edge clip 94 (or any other embodiment or variation), permits the flexible cover 68 to be disposed against the windshield pane 52 (or other structure, such as the cap 46) at any suitable angle Φ for a particular boat design. In other words, flexibility with respect to the angle Φ permits greater flexibility with respect to installation of the flexible cover 68. It is noted that the prior art snap-fastener approach is considered to be limiting because a large angle (i.e., 90°) would not be possible. A large angle would apply a sufficient force on the snap fastener to cause the male and female portions to separate from one another. It is conceivable that the angle Φ may range between 0 and 180° or more.

Figure 16:
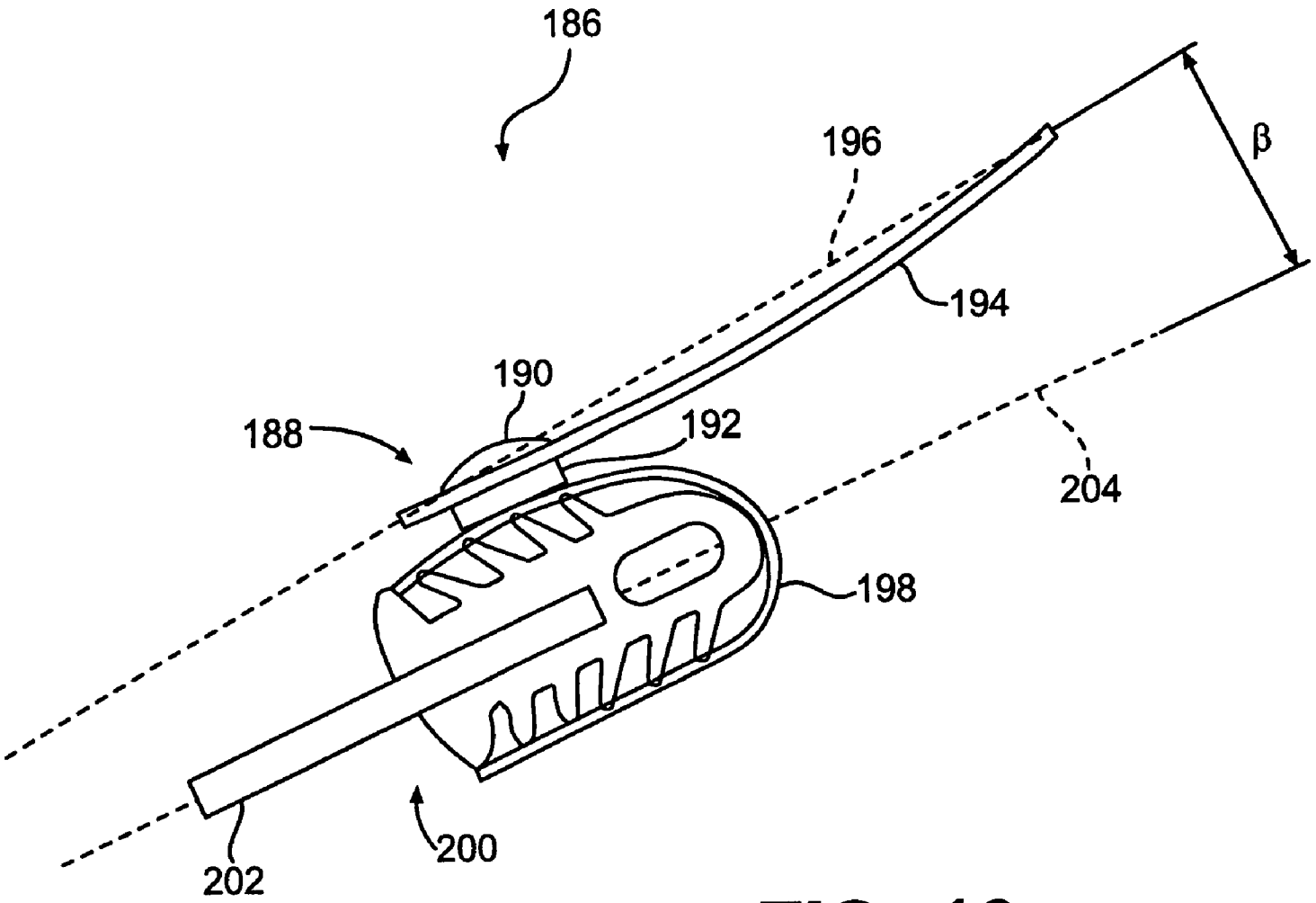
FIG. 16 PRIOR ART
FIG. 16 is a side view illustration of a conventional snap fastener for connecting a flexible top to a windshield top rail.

To assist with an understanding of how this aspect of the invention departs from the prior art, FIG. 16 is provided. FIG. 16 illustrates a conventional snap fastener system. The conventional snap fastener system 186 includes a snap fastener 188 with a female portion 190 and a male portion 192. The female portion 190 is affixed to a flexible cover 194 that defines a first axis 196. The male portion 192 of the snap fastener 188 connects to a top rail 198 of a windshield assembly 200. The windshield pane 202 defines a second axis 204. The first axis 196 and the second axis 204 define the sweep of the angle β. As discussed, the angle β must be small to prevent the female portion 190 from disengaging the male portion 192. This emphasizes how the invention assists provides greater flexibility when installing the cover 68, as discussed in FIGS. 11 and 12.

Figure 13:
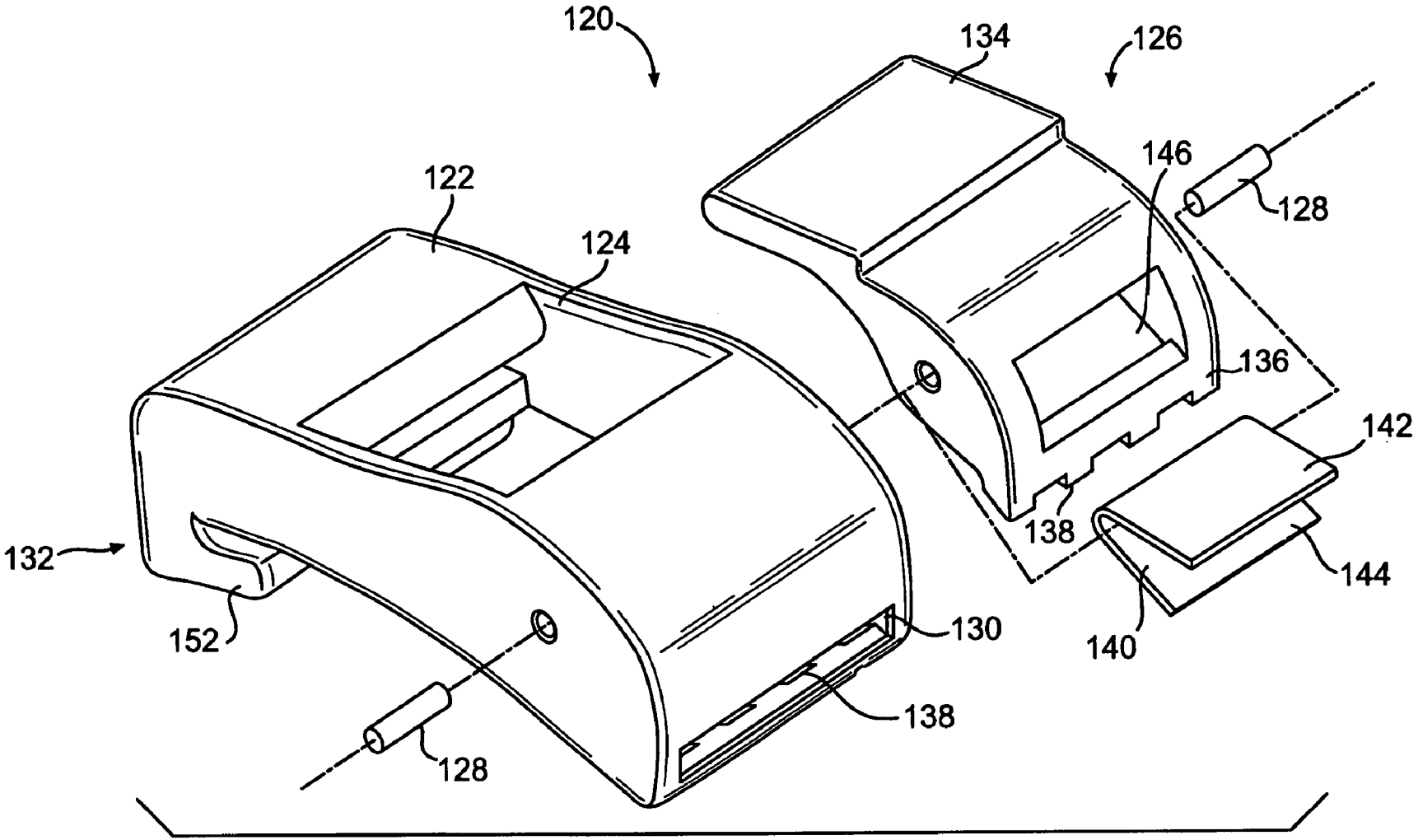
FIG. 13 is an exploded, perspective view of a fifth embodiment of an edge clip of the invention.

FIG. 13 is a perspective illustration of a fifth embodiment of an edge clip 120 according to the invention. This embodiment is a spring-loaded version of an edge clip 120 contemplated for use with the invention.

As shown in FIG. 13, the edge clip 120 includes a body 122. The body 122 is essentially rectangular in shape, although other shapes may be employed without departing from the scope of the invention. As discussed above, the body 122 may be made from any number of suitable materials.

The body 122 includes a central opening 124 in which a spring-loaded lever 126 is positioned. The spring-loaded lever 126 pivots around a pin 128 also disposed within the body 122. The pin 128 may be a single pin or pins that extend inwardly from the sides of the body 122, as shown in FIG. 13.

The body also includes an inlet 130 and an outlet 132. A strap 22 (not shown in FIG. 13) passes from the inlet 130 to the outlet 132 and to be retained by the edge clip 120. While not illustrated, the strap 22 may be folded over the edge clip 120 so that the top end 24 and the bottom end 26 may be affixed to one another via a suitable fastener.

The spring-loaded lever 126 includes a release portion 134. The release portion 134 is accessible though the opening 124. When the release portion 134 is depressed, the edge clip 120 releases the strap 22 so that the strap 22 may move freely between the inlet 130 and the outlet 132.

The spring-loaded lever 126 also includes a gripping portion 136. The gripping portion 136 includes one or more teeth 138 so that the gripping portion 136 may exert a sufficient retentive force on the strap disposed within the edge clip 120. The teeth 138 cooperate with a surface 139 and the spring 140 to establish a retaining element for the strap 22, as in prior embodiments.

A spring 140 is positioned between the lever 126 and the body 122. The spring 140 has a first leg 142 and a second leg 144. The first and second legs 142, 144 joint at an apex to form the V-shaped spring 140. The spring 140 pivots about the pin 128, just as the lever 126 does.

Figure 14:
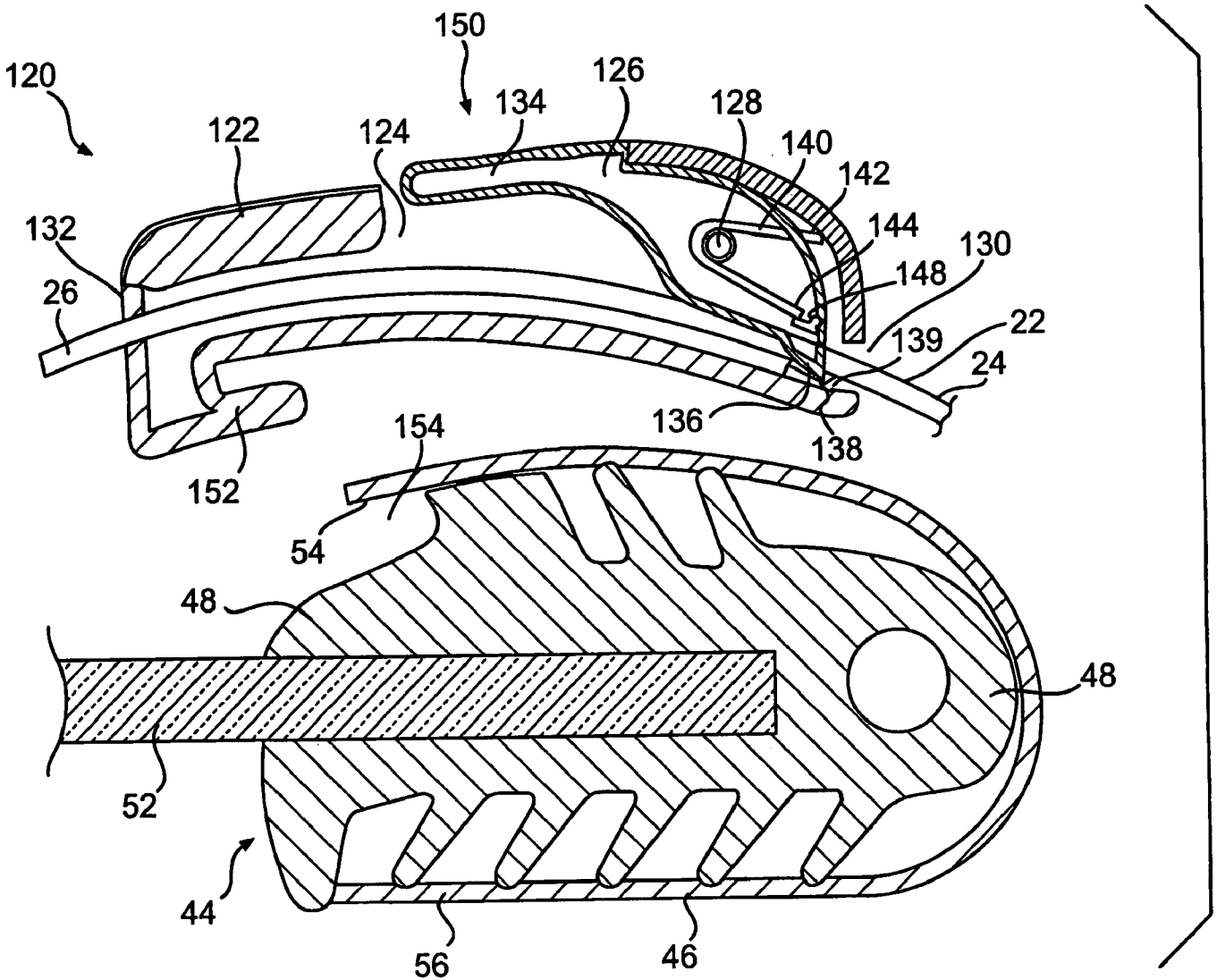
FIG. 14 is a cross-sectional side view of the fifth embodiment of the edge clip illustrated in FIG. 13.

With reference to FIG. 14, the spring 140 is disposed within the lever 120 such that the first leg 142 extends through the opening 146 to contact an interior surface of the body 122. The second leg 144 rests against a ledge 148 in the lever 126. The spring 140 is biased to exert a force on the ledge 148 to bias the lever 126 so that the teeth 138 engage the strap 22. Application of a force, indicated by the arrow 150, on the lever 126 causes the spring 140 to compress, thereby disengaging the teeth 138 from the strap 22. When the force 150 is no longer applied to the release portion 134 of the lever 126, the spring 140 resumes application of a force on the teeth 138 to engage the strap 22.

The edge clip 120 is provided with an integral hook 152 to engage the interior leg 54 of the cap 46, as illustrated in FIG. 14. The integral hook 152 engages a depression 154 in the insert 48 within the top rail 42 of the windshield assembly 44, just as in prior embodiments.

As should be immediately apparent to those skilled in the art, the integral hook 152 may be replaced with hooks akin to the hook 38 or the S-shaped hook 112 as in prior embodiments, without departing from the invention.

Returning to the discussion of the spring 140, it is contemplated that the spring 140 will be made from a suitable metal material such as a metal alloy, steel, stainless steel, copper, or the like. Of course, non-metallic materials also may be used without departing from the scope of the invention.

Figure 15:
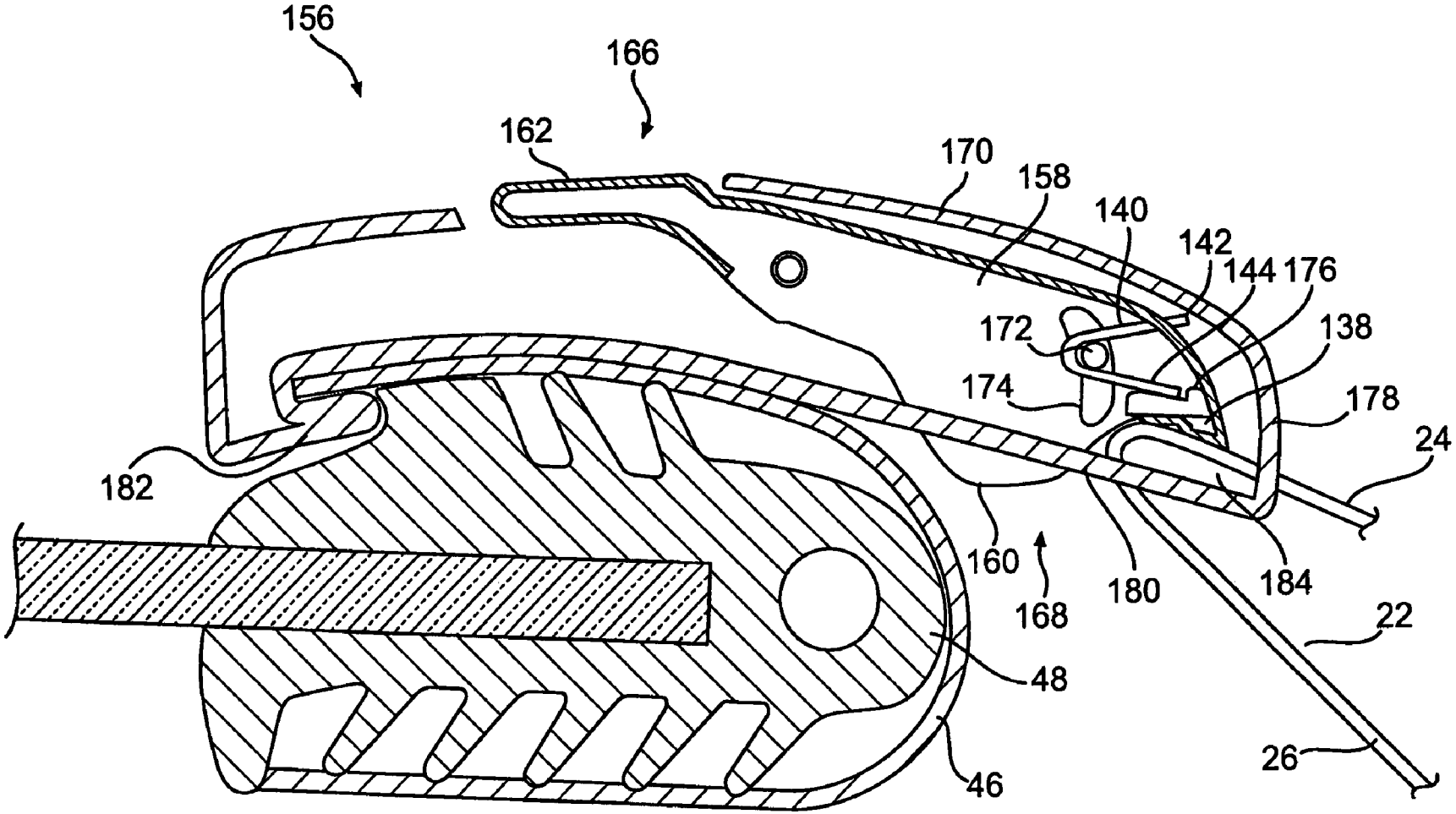
FIG. 15 is a cross-sectional side view of a sixth embodiment of an edge clip according to the invention.

FIG. 15 illustrates a sixth embodiment of an edge clip 156 according to the invention. This embodiment is similar to the embodiment illustrated in FIG. 14. Here, however, there are two differences of interest. First, the strap includes a reversal of direction, as in the embodiment illustrated in FIG. 9. Second, the lever 158 includes a protrusion 160 on its underside to permit a user to disengage the lever 158 from the strap 22. This sixth embodiment of the edge clip 156, therefore, provides two areas, the protrusion 160 and a release portion 162, for disengaging the teeth 138 from the strap 22.

As illustrated in FIG. 15, the lever 158 is permitted to pivot around a pin 164 upon application of a force 166 or a force 168. The spring 140, which includes the first and second legs 142, 144 as in the prior embodiment, is biased against the interior surface of the body 170 of the edge clip 156. A pin 172 permits the spring 140 to flex, also as in the prior embodiment. So that the pin 172 may be connected internally to the body 170, the lever 156 is provided with a curved groove 174. As in the prior example, the second leg 144 of the spring 140 rests against a ledge 176 in the lever 158.

As shown, the strap 22 enters the body 170 via an inlet 178 and exits from the body via an outlet 180.

The edge clip 156 is provided with an integral hook 182, as in prior examples. The integral hook 182 may be substituted with other hook variants as described herein and as should be appreciated by those skilled in the art.

As should be apparent, the teeth 138 cooperate with the spring 140 and a surface 184 to establish a retaining element for the strap 22, as in prior examples.

As noted above, the embodiments described above are intended to be illustrative of the breadth of the scope of this invention. As should be appreciated by those skilled in the art, there are numerous variations and equivalents to the embodiments described and illustrated herein. Those variations and equivalents are intended to fall within the scope of this invention.

What is claimed is:

1. A system for securing a flexible cover to a boat, comprising:

a flexible cover defining a peripheral edge;

at least one flexible member attached to the flexible cover adjacent to the peripheral edge;

at least one edge clip adjustably disposed on the flexible member, wherein the at least one edge clip comprises a body defining an inlet and an outlet, with the at least one flexible member extending from the inlet to the outlet, and a retaining element disposed within the body to restrain movement of the flexible member with respect to the inlet and the outlet; and a hook, connectible between the at least one edge clip and the boat for securing the edge clip to the boat, thereby securing the flexible cover to the boat via the at least one flexible member.

2. The system of claim 1, wherein the flexible cover comprises at least one of a woven material, a non-woven material, and a transparent material.

3. The system of claim 1, wherein the at least one flexible member comprises at least one of a lanyard, a rope, a string, and a strap.

4. The system of claim 1, wherein at least a portion of the peripheral edge includes a sealing element.

5. The system of claim 1, wherein at least a portion of the peripheral edge includes a stiffening element.

6. The system of claim 5, wherein the stiffening element defines a first axis and a structure on the boat defines a second axis, and an angle between the first and second axes is adjustable between 0 and 180° or more.

7. The system of claim 1, wherein the retaining element comprises:

a lever pivotally disposed in the body, the lever defining an opened position and a closed position such that, in the opened position, the lever permits the at least one flexible member to move between the inlet and the outlet and, in the closed position, the lever discourages the at least one flexible member from moving between the inlet and the outlet;

one or more teeth to engage the at least one flexible member when the lever is in the closed position; and a spring to bias the lever into engagement of the at least one flexible member.

8. The system of claim 7, further comprising:

a fastener disposed on first and second ends of the at least one flexible member to permit the first and second ends of the at least one flexible member to be connected to one another when the lever is in the closed position.

9. The system of claim 1, wherein the retaining element comprises:

a barrier disposed within the body, wherein the at least one flexible member extends around the barrier in such a manner that tension on the at least one flexible member discourages movement of the at least one flexible member between the inlet and the outlet; and a fastener disposed on first and second ends of the at least one flexible member to permit the first and second ends of the at least one flexible member to be connected to one another, thereby providing the tension to discourage movement of the at least one flexible between the inlet and the outlet.

10. The system of claim 9, further comprising:

a tongue positioned within the body adjacent to the barrier to help direct the at least one flexible member from the inlet to the outlet.

11. The system of claim 1, wherein the hook is integrally formed with the edge clip and is adapted to be secured to a structure on the boat.

12. The system of claim 1, wherein the hook is U-shaped, is attached to the edge clip, and is adapted to be secured to a structure on the boat.

13. The system of claim 1, wherein the hook is S-shaped with a first end being adapted to engage a structure on the boat and a second end being adapted to engage the body.

14. The system of claim 13, wherein the second end of the hook is removably connectable to the body.

15. The system of claim 1, wherein the edge clip is secured on an interior surface of the boat, within a passenger area, while the portion of the peripheral edge of the flexible cover engages an exterior surface of the boat, outside of the passenger area.

16. A system for securing a flexible cover to a boat, comprising:

a flexible cover defining a peripheral edge;

at least one flexible member attached to the flexible cover adjacent to the peripheral edge;

at least one edge clip adjustably disposed on the flexible member, wherein the at least one edge clip comprises a body defining an inlet and an outlet, with the at least one flexible member extending from the inlet to the outlet, and a barrier disposed within the body, wherein the at least one flexible member extends around the barrier to establish a reversal in a direction of the at least one flexible member between the inlet and the outlet; and a fastener disposed on first and second ends of the at least one flexible member to permit the first and second ends of the at least one flexible member to be connected to one another to provide tension in the at least one flexible member, wherein at least the barrier and the fastener cooperate to restrain the at least one flexible member from moving with respect to the inlet and the outlet; and a hook, connectible between the at least one edge clip and the boat for securing the edge clip to the boat, thereby securing the flexible cover to the boat via the at least one flexible member.

17. The system of claim 16, wherein the at least one flexible member comprises at least one of a lanyard, a rope, a string, and a strap.

18. The system of claim 16, wherein the fastener comprises at least one of hook and loop fastening means and a snap.

19. The system of claim 16, further comprising:

a tongue positioned within the body adjacent to the barrier to help direct the at least one flexible member from the inlet to the outlet.

20. The system of claim 16, wherein the hook is integrally formed with the body.

21. The system of claim 16, wherein the edge clip is secured on an interior surface of the boat, within a passenger area, while the portion of the peripheral edge of the flexible cover engages an exterior surface of the boat, outside of the passenger area.

22. The system of claim 16, wherein the hook is integrally formed with the edge clip and is adapted to be secured to a structure on the boat.

23. The system of claim 16, wherein the hook is U-shaped, is attached to the edge clip, and is adapted to be secured to a structure on the boat.

24. The system of claim 16, wherein the hook is S-shaped with a first end being adapted to engage a structure on the boat and a second end being adapted to engage the body.

* * * * *